US010228128B2

(12) United States Patent
Geng et al.

(10) Patent No.: US 10,228,128 B2
(45) Date of Patent: Mar. 12, 2019

(54) ADDITIONAL PRIMARY AIR ACCESS FOR SURFACE GAS BURNERS

(71) Applicant: WHIRLPOOL CORPORATION, Benton Harbor, MI (US)

(72) Inventors: Tao Geng, St. Joseph, MI (US); Victor H. Manrique, St. Joseph, MI (US); Timothy A. Mayberry, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 271 days.

(21) Appl. No.: 15/333,465

(22) Filed: Oct. 25, 2016

(65) Prior Publication Data

US 2017/0038061 A1 Feb. 9, 2017

Related U.S. Application Data

(63) Continuation of application No. 14/102,864, filed on Dec. 11, 2013, now Pat. No. 9,513,012.

(51) Int. Cl.

| | |
|---|---|
| ***F23L 1/00*** | (2006.01) |
| ***F23D 14/06*** | (2006.01) |
| ***F24C 3/08*** | (2006.01) |

(52) U.S. Cl.

CPC ..... *F23D 14/06* (2013.01); *F23L 1/00* (2013.01); *F24C 3/08* (2013.01)

(58) Field of Classification Search

CPC ..... F24C 3/08; F23D 14/06; F23L 1/00

See application file for complete search history.

(56) References Cited

U.S. PATENT DOCUMENTS

| | | | |
|---|---|---|---|
| 5,653,219 | A | 8/1997 | Taplan et al. |
| 6,299,436 | B1 | 10/2001 | Huang |
| 6,589,046 | B2 | 7/2003 | Harneit |
| 6,889,685 | B2 | 5/2005 | Dane |
| 7,291,009 | B2 | 11/2007 | Kamal et al. |
| 7,661,954 | B2 | 2/2010 | Harneit |
| 7,901,205 | B2 | 3/2011 | Trochou |
| 8,302,593 | B2 | 11/2012 | Cadima |
| 8,408,897 | B2 | 4/2013 | Rossi et al. |
| 2009/0047611 | A1 | 2/2009 | Armanni |
| 2010/0279238 | A1 | 11/2010 | Harneit |
| 2010/0319677 | A1 | 12/2010 | Lacche |
| 2012/0090595 | A1 | 4/2012 | Shaffer et al. |
| 2013/0306055 | A1 | 11/2013 | Cadima |

FOREIGN PATENT DOCUMENTS

| | | | |
|---|---|---|---|
| EP | 2226560 | A2 | 9/2010 |
| WO | 2006005428 | A1 | 1/2006 |

OTHER PUBLICATIONS

European Patent Office, "European Search Report for European Patent Application No. 14197194.5," dated Jul. 15, 2015 (7 pages).

*Primary Examiner* — Alfred Basichas

(74) *Attorney, Agent, or Firm* — Price Heneveld LLP

(57) ABSTRACT

A gas burner unit for a cooktop includes a spreader positioned above a top surface of the cooktop to define a gap therebetween and having a plurality of gas outlets. The gas burner unit further includes a venturi in fluid communication with the gas outlets and an orifice holder having a plurality of protrusions defining a plurality of upwardly directed primary air inlets therethrough. The plurality of upwardly directed primary air inlets are in fluid communication with the gap on respective first ends thereof and with the venturi on respective second ends thereof opposite the first ends.

20 Claims, 7 Drawing Sheets

ADDITIONAL PRIMARY AIR ACCESS FOR SURFACE GAS BURNERS

CROSS-REFERENCE TO RELATED APPLICATION

This application is a continuation of U.S. patent application Ser. No. 14/102,864 (now U.S. Pat. No. 9,513,012), filed on Dec. 11, 2013, entitled "ADDITIONAL PRIMARY AIR ACCESS FOR SURFACE GAS BURNERS," the disclosure of which is hereby incorporated herein by reference in its entirety.

BACKGROUND

The present disclosure relates generally to primary air inlets to supply primary air to a gas burner to facilitate combustion of fuel gas supplied to the burner. The primary air is mixed with the fuel gas prior to ignition of the gas to form a fuel-rich mixture for ignition. The remaining air required for complete combustion is obtained from the ambient air in the room following ignition, and is referred to herein as secondary air.

SUMMARY

One aspect of the present disclosure includes a gas burner unit for a cooktop includes a spreader positioned above a top surface of the cooktop to define a gap therebetween and having a plurality of gas outlets. The gas burner unit further includes a venturi in fluid communication with the gas outlets and an orifice holder having a plurality of protrusions defining a plurality of upwardly directed primary air inlets therethrough. The plurality of upwardly directed primary air inlets are in fluid communication with the gap on respective first ends thereof and with the venturi on respective second ends thereof opposite the first ends.

In another aspect, the present disclosure includes a cooktop having at least one gas burner unit includes an opening defined through a surface of the cooktop and a venturi extending through the opening and fluidically coupling with the gas burner unit. The cooktop further includes a plurality of upwardly directed primary air inlets extending through the surface in fluid communication with the venturi and at least partially defining respective fluid paths from above the cooktop to the venturi and a ridge extending upwardly about a perimeter of each upwardly directed primary air inlet.

In another aspect, the present disclosure includes a cooktop includes a plurality of gas burner units including a first gas burner unit having a spreader positioned above a surface of the cooktop to define a gap therebetween. A first primary air inlet is located remotely from the gas burner units to allow the ingress of ambient air to an area below the cooktop. A second primary air inlet is associated with the first burner unit and is positioned beneath the spreader to define at least a portion of a flow path from the gap to the area beneath the surface adjacent the first burner unit and further beneath the spreader.

These and other features, advantages, and objects of the present device will be further understood and appreciated by those skilled in the art upon studying the following specification, claims, and appended drawings.

DETAILED DESCRIPTION OF EMBODIMENTS

Figure 1:
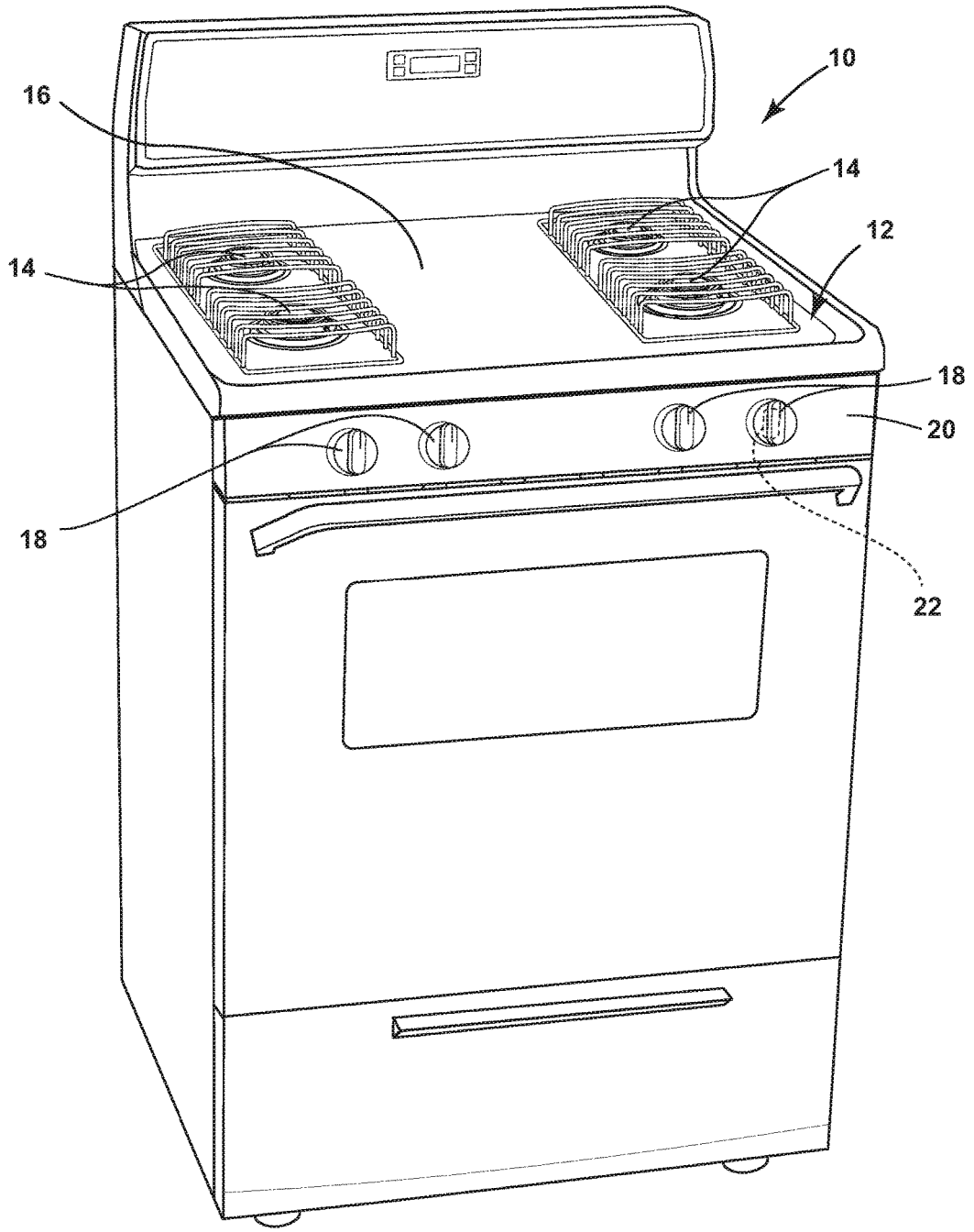
FIG. 1 is a top perspective view of a range with gas burner units according to the present disclosure.
Figure 2:
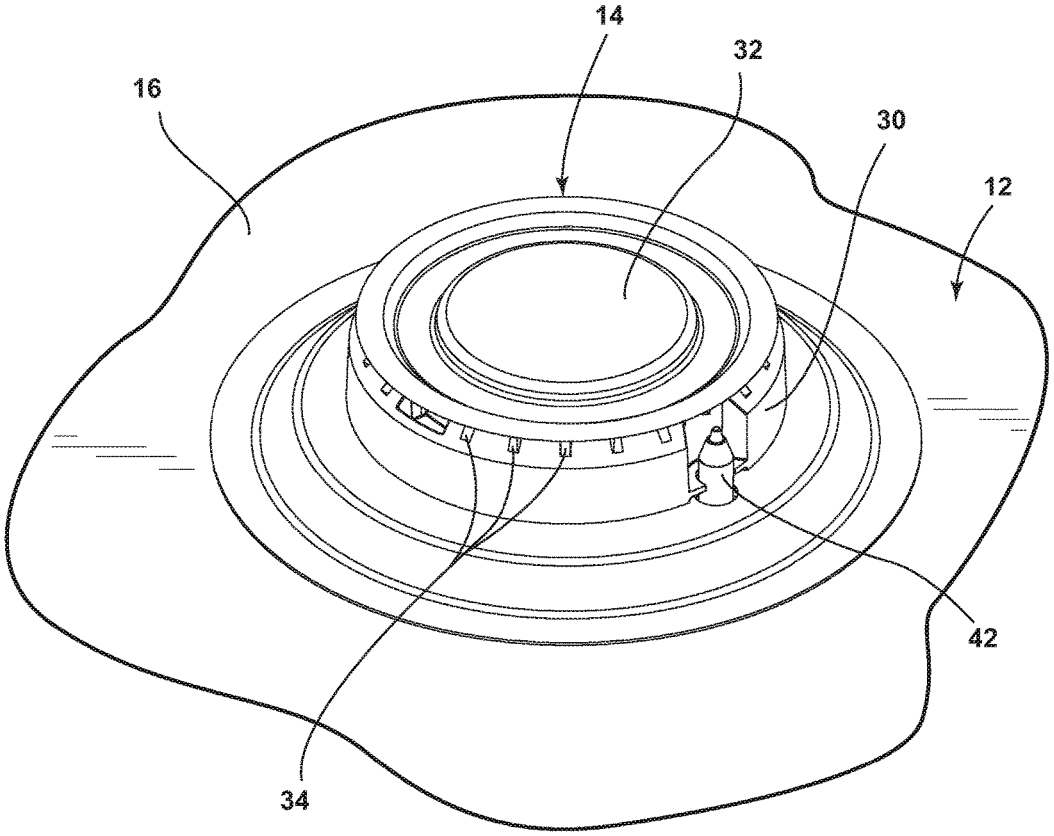
FIG. 2 is a top perspective view of a gas burner unit according to the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to the embodiment generally illustrated in FIG. 1, reference numeral 10 generally defines a range having a cooktop 12 with a plurality of gas burner units 14 arrayed about a top surface 16 of the cooktop 12, with knobs 18 to control the gas burner units 14. The present disclosure is relevant for use with any gas burner units 14, whether located on a stand-alone hob, or a cooktop 12 associated with a range 10. The knobs 18 are located on a front edge 20 of the cooktop 12, and a general primary air inlet 22 (also called an alternate primary air inlet herein) is provided behind one or more of the knobs 18. The alternate primary air inlet 22 allows ambient air from the front of the cooktop 12 to enter the space below the cooktop 24 (FIG. 5), where certain components of the gas burner unit 14 are located, as further described below. Primary air which enters the area 24 below the cooktop 12 supplies any of the plurality of gas burner units 14 with primary air. In other embodiments, the alternate primary air inlets 22 may be positioned below knobs 18 on a top surface 16 of the cooktop 12. In such embodiments, the alternate primary air inlets 22 allow the inlet of primary air into the area 24 below the cooktop 12 in a location remote from the gas burner units 14, where the primary air is available to any of the plurality of gas burner units 14.

As shown in the embodiment depicted in FIGS. 2-8, the gas burner unit 14 includes a spreader 30 and a burner cap 32 located above the top surface 16 of the cooktop 12. The spreader 30 includes a plurality of gas outlets 34, which are enclosed by the burner cap 32 and a venturi mixing chamber 36 (shown in FIGS. 7-8) in fluid connection with the plurality of gas outlets 34. An orifice holder 40 is positioned at least partially below the cooktop 12, and operates to mechanically secure various elements of the gas burner unit 14 in physical alignment with each other and the cooktop 12, including at least the spreader 30, a gas orifice 40, and a spark electrode 42. The orifice holder 38 includes a main body portion 44, a flange 46 extending outwardly from the main body 44, a spark electrode locating arm 48 extending outwardly from the main body 44, a central cylindrical portion 50 extending upwardly from the main body 44, and a plurality of protrusions 52 extending upwardly from the main body 44, as further described below. The orifice holder 38 can be fabricated from a variety of suitable materials, such as brass, aluminum, cast iron, ceramics, heat-resistant plastics, or any other material capable of withstanding the temperatures resulting from burner operation for an extended period of time and over numerous thermal cycles.

Figure 3:
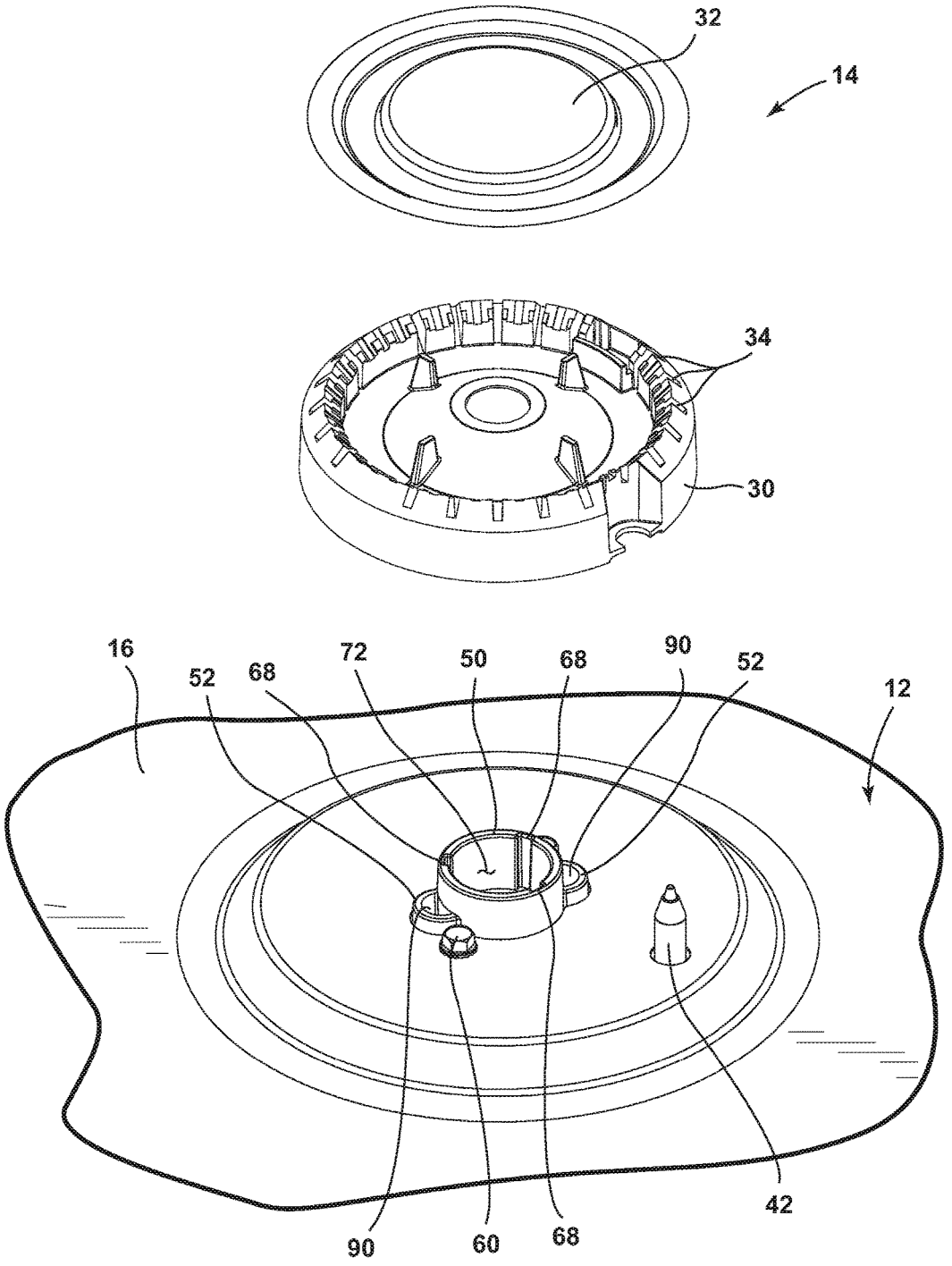
FIG. 3 is a top perspective partially exploded view of the gas burner unit shown in FIG. 2.
Figure 4:
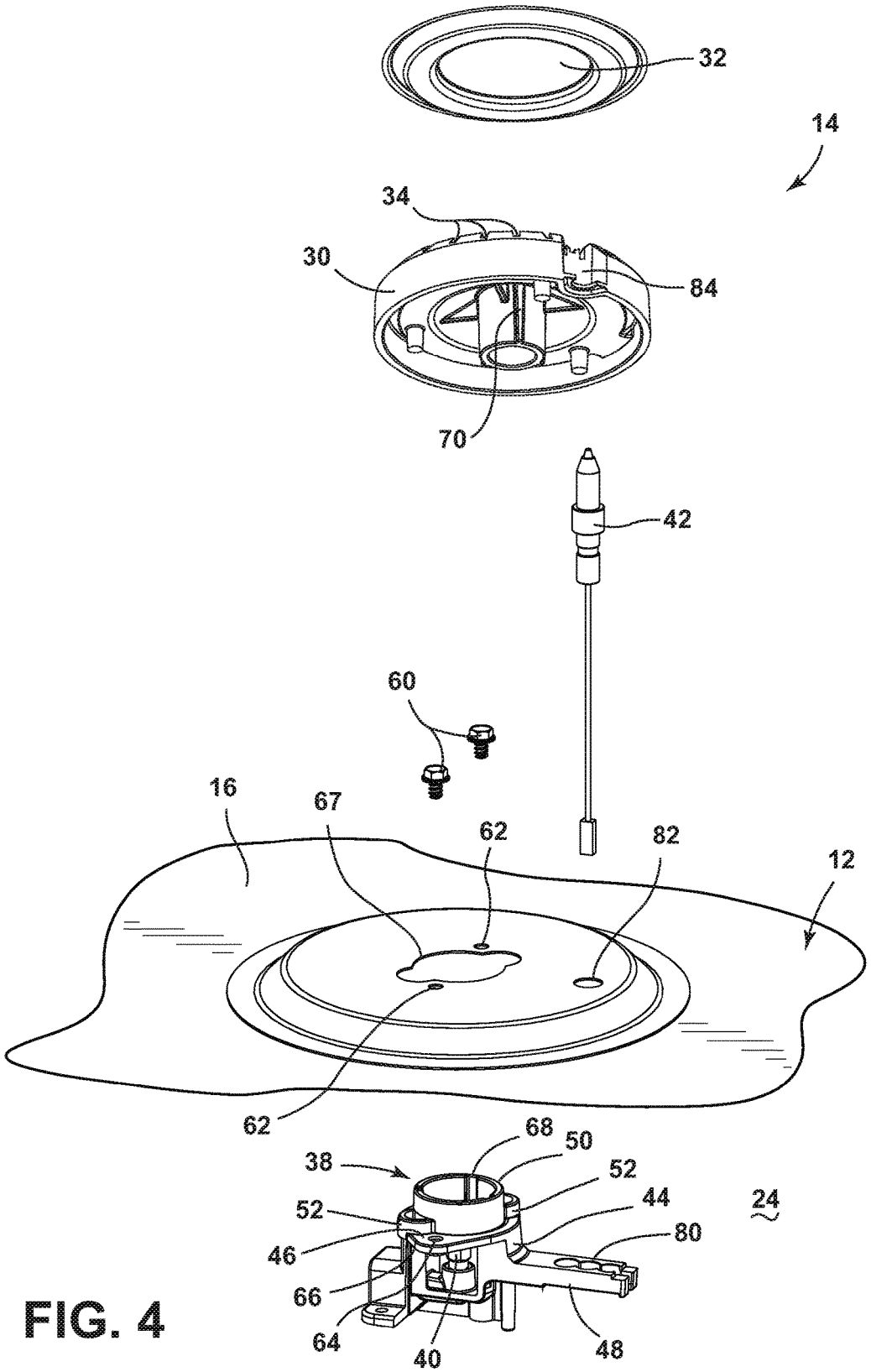
FIG. 4 is a top perspective exploded view of the gas burner unit shown in FIG. 2.
Figure 8:
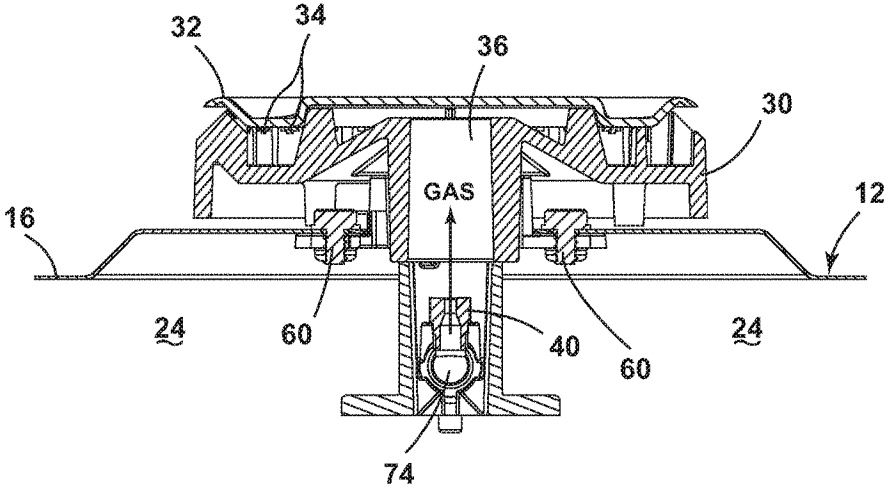
FIG. 8 is a cross sectional view of the gas burner shown in FIG. 2 taken along the line VIII-VIII in FIG. 6.

As best shown in the embodiment illustrated in FIGS. 3, 4, and 8, the orifice holder 38 is affixed to the cooktop 12 by screwing a plurality of screws 60 through screw holes 62 in the cooktop 12 and into receiving holes 64 in the flange 46 extending outwardly from a top edge 66 of the main body 44 of the orifice holder 38. As shown in FIG. 4, the main body 44 of the orifice holder 38 mechanically secures the gas orifice 40 in position, and locates the orifice 40 centrally within the gas burner unit 14 to direct gas upwardly into the venturi mixing chamber 36 defined by the spreader 30. The orifice 40 optionally includes threads which are screwed into a threaded receiving portion of the orifice holder 38 to maintain the orifice 40 in the desired position and orientation. Other fittings between the orifice holder 38 and the orifice 40, such as mechanical engagement, friction fit, suitable adhesives, or any other fittings capable of maintaining the position of the orifice 40 through the temperatures and pressures generally encountered by orifice holders 38 and orifices 40 may be used to secure the orifice 40 in the orifice holder 38. The central cylindrical portion 50 extends upwardly from the main body 44 and the flange 46 through an opening 67 in the cooktop 12 to mechanically engage the spreader 30. Asymmetrical locating grooves 68 are provided in the central cylindrical portion 50 to engage corresponding alignment tabs 70 on the spreader 30. The asymmetrical fitting between the orifice holder 38 and the spreader 30 ensures that the spreader 30 and venturi 36 are coaxially aligned with the gas orifice 40. The main body 44 is in fluid connection with the spreader 30 through a bore 72 in the central cylindrical portion 50 of the orifice holder 38, allowing gas to flow from the orifice 40 into the venturi mixing chamber 36. Also, as shown in FIG. 8, the orifice holder 38 includes a gas inlet 74, fluidly connecting a gas supply line (not shown) with the gas orifice 40.

Also as shown in FIG. 4, the orifice holder 38 mechanically secures the spark electrode 42 in position with respect to the cooktop 12 and the spreader 30. The spark locating arm 48 extends axially outwardly from the main body 44 of the orifice holder 38 with an aperture 80 therethrough to receive the spark electrode 42. The spark electrode 42 extends upwardly through a spark electrode hole 82 in the cooktop 12 and into a receiving portion 84 of the spreader 30.

As shown in FIGS. 3-4, the orifice holder also includes a plurality of protrusions 52 extending upwardly from the flange 46, which define a plurality of upwardly directed primary air inlets 90 which extend through the opening 67 in the cooktop 12. The plurality of primary air inlets 90 are in fluid communication with the venturi mixing chamber 36, and permit the supply of ambient air from above the top surface 16 of the cooktop 12 to the venturi mixing chamber 36 to act as primary air which mixes with the fuel gas to form a fuel-rich mixture of gas and primary air for ignition. The protrusions 52 preferably extend above the top surface 16 of the cooktop 12, thereby creating a barrier to the entrance of liquids or other spilled materials on the cooktop 12 from entering the upwardly directed primary air inlets 90. In the embodiment depicted in FIGS. 3-4, the protrusions 52 extend about 3.8 mm above the flange 46, resulting in a protrusion of approximately 2.9 mm above the top surface 16 of the cooktop 12.

The cross sectional area of the primary air inlets 90 is preferably greater than about 63 $mm^2$ to allow primary air to enter the venturi 36 at the desired pressure and speed. The size of the primary air inlets 90 can be increased beyond 63 $mm^2$, but the size and arrangement of the primary air inlets are preferably maintained so that the primary air inlets 90 are located on the area of the cooktop 12 covered by the spreader 30, to maintain the aesthetic of the cooktop 12 and to prevent spilled materials from entering the cooktop 12 by having the spreader 30 shield the primary air inlets 90. Additionally, the spreader 30 is preferably separated from the top surface 16 of the cooktop 12 by at least about 2 mm to allow air flow from the top surface 16 of the cooktop 12 to the primary air inlet 90.

The upwardly directed primary air inlets 90 are positioned in close proximity to the venturi 36, and are physically associated with a particular gas burner unit 14, to provide primary air primarily to that particular gas burner unit 14. These upwardly directed primary air inlets 90 associated with each gas burner unit 14 prevent pressure drops of the primary air that can otherwise occur when multiple gas burner units 14 on the cooktop 12 are used simultaneously. The upwardly directed primary air inlets 90 also assist the gas burner unit 14 to operate at a low simmer rate during sudden changes in pressure, such as those experienced when an oven door is opened during operation of the gas burner unit 14 at a simmer rate. In the embodiment depicted in FIGS. 2-8, the upwardly directed primary air inlets 90 are immediately adjacent the central cylindrical portion 50 of the orifice holder 38. However, in alternate embodiments, the primary air inlets 90 could be separated from the central cylindrical portion 50, and could extend through additional openings in the cooktop 12.

Figure 5:
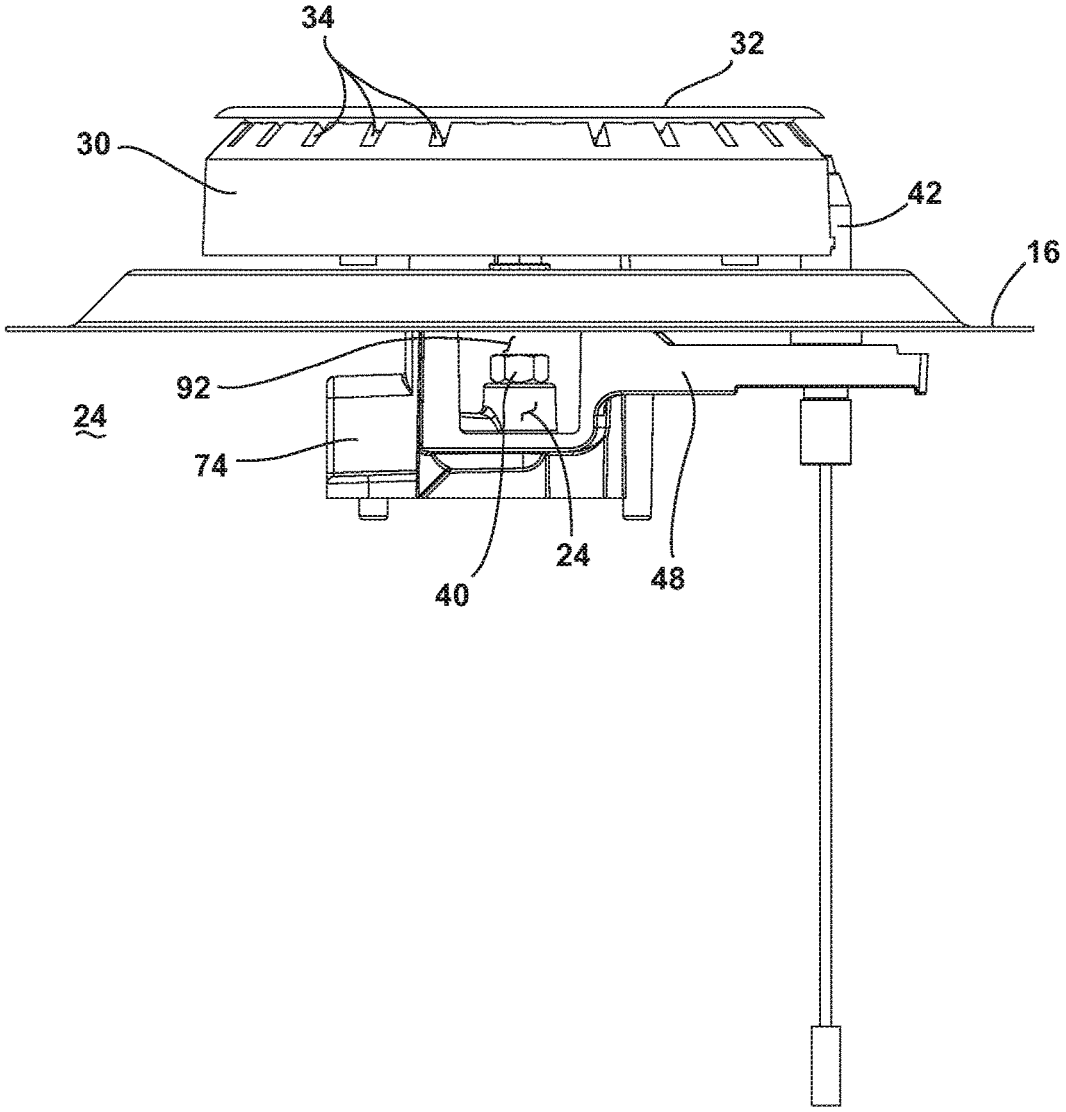
FIG. 5 is a side elevation view of the gas burner unit shown in FIG. 2.

As shown in FIG. 5, the main body 44 of the orifice holder 38 has openings 92, allowing primary air from the general primary air inlet 22 to enter the main body 44 of the orifice holder 38, which is in fluid communication with the venturi mixing chamber 36. This open main body 44 design allows primary air to enter the venturi mixing chamber 36 from both a general primary air inlet 22 (supplying air to the area 24 below the cooktop 12 to reach multiple gas burner units 14) and the upwardly directed primary air inlets 90 specifically associated with the particular gas burner unit 14.

Figure 6:
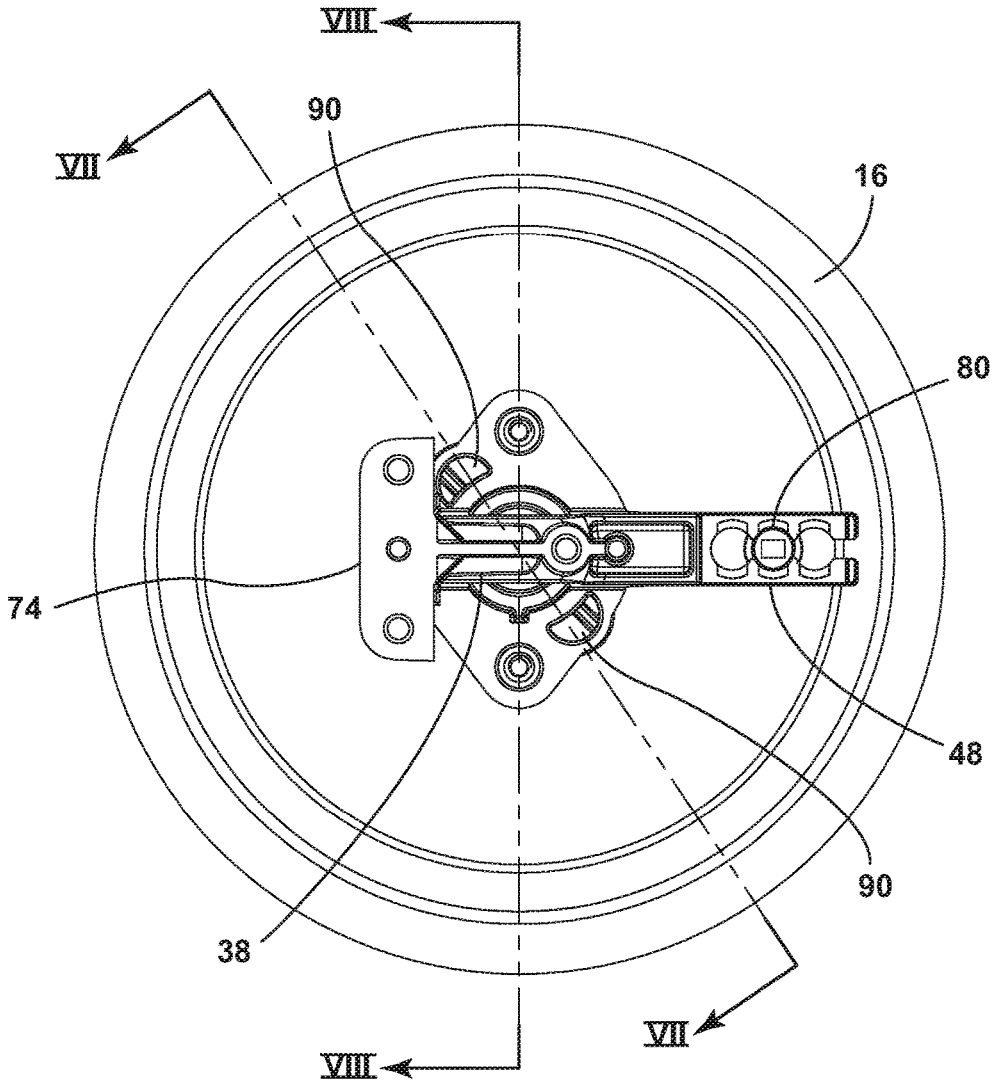
FIG. 6 is a bottom plan view of the gas burner shown in FIG. 2.
Figure 7:
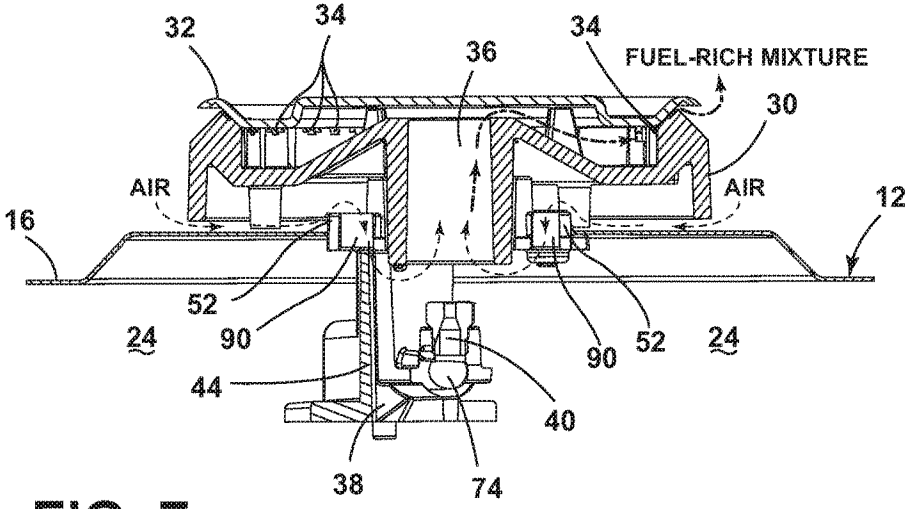
FIG. 7 is a cross sectional view of the gas burner shown in FIG. 2, taken along the line VII-VII in FIG. 6.

As shown in the embodiment depicted in FIGS. 6-7, ambient air from above the top surface 16 of the cooktop 12 is drawn underneath the spreader 30 and into the upwardly directed primary air inlets 90. The upwardly directed primary air inlets 90 are in fluid communication with the venturi mixing chamber 36, through the main body 44 of the orifice holder 38. The flow of gas through the orifice 40 and into the venturi 36 creates a vacuum effect to pull in the ambient air through the upwardly directed primary air inlets 90 and into the venturi 36. In the venturi 36, the ambient air is mixed with the gas prior to combustion, creating a fuel-rich mixture. The fuel-rich mixture then flows outwardly through the gas outlets 34 of the spreader 30. When the fuel-rich mixture exits the gas outlets 34, it is ignited by the spark electrode 42, resulting in burner flames.

As shown in FIG. 8 in greater detail, the orifice holder 38 includes a gas inlet 74, which receives a gas supply line (not shown) and which provides a fluid connection from the gas supply line to the orifice 40. The orifice 40 is coaxially aligned with the venturi mixing chamber 36 to direct gas upwardly into the venturi chamber 36.

In one aspect, the present disclosure includes a gas burner unit 14 for a cooktop 12 having a spreader 30 positioned above the top surface 16 of the cooktop 12. The spreader 30 has gas outlets 34. A venturi 36 is in fluid communication with the gas outlets 34. An orifice holder 38 having a plurality of protrusions 52 defining a plurality of upwardly directed primary air inlets 90. The plurality of upwardly directed primary air inlets 90 are in fluid communication with the venturi 36.

In another aspect, the present disclosure includes a cooktop 12 having at least one gas burner unit 14, with a plurality of primary air inlets 90 extending through a top surface 16 of the cooktop 12. The plurality of primary air inlets 90 are in fluid communication with a venturi 36 to provide ambient air from above the cooktop 12 to the venturi 36. A ridge formed by the protrusions 52 extends upwardly about the edge of each primary air inlet 90.

In another aspect, the present disclosure includes a cooktop 12 having a plurality of gas burner units 14 including a first gas burner unit 14. A first primary air inlet 22 is located remotely from the gas burner units 14, which allows the ingress of ambient air to an area 24 below the cooktop 12 to supply primary air to the plurality of gas burner units 14. A second primary air inlet 90 is associated with one of the plurality of gas burner units 14. The second primary air inlet 90 allows ingress of ambient air from above a top surface 16 of the cooktop 12 to supply primary air to the first gas burner unit 14, wherein the second primary air inlet 90 is directed upwardly through the top surface 16 of the cooktop 12.

The orifice holder 38 for the gas burner unit 14 described herein performs three functions: (1) it aligns components of the gas supply system including the gas inlet 74, orifice 40, venturi 36 and gas outlets 34; (2) it prevents spillage of food, liquids, or other materials into the primary air inlets 90; and (3) it provides additional primary air access to improve the combustion of gas during operation of the gas burner unit 14.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A gas burner unit for a cooktop, comprising:

a spreader positioned above a top surface of the cooktop to define a gap therebetween, the spreader having a plurality of gas outlets;

a venturi in fluid communication with the gas outlets; and an orifice holder having a plurality of protrusions defining a plurality of upwardly directed primary air inlets therethrough, wherein the plurality of upwardly directed primary air inlets are in fluid communication with the gap on respective first ends thereof and with the venturi on respective second ends thereof opposite the first ends.

2. The gas burner unit of claim 1, wherein each of the upwardly directed primary air inlets has a semi-circular shape.

3. The gas burner unit of claim 1, having two upwardly directed primary air inlets.

4. The gas burner unit of claim 1, wherein the gas burner spreader is secured to the orifice holder using grooves and alignment tabs to maintain the desired coaxial alignment between the gas burner spreader and the orifice holder.

5. The gas burner unit of claim 1, wherein the upwardly directed primary air inlets have a total cross sectional area of about 63 $mm^2$ or greater.

6. The gas burner unit of claim 1, wherein the orifice holder has a main body portion in which a gas orifice is mechanically secured in coaxial alignment with the venturi, and wherein the main body is in fluid connection with the venturi.

7. The gas burner unit of claim 6, further comprising:

a plurality of alternate primary air inlets that are in fluid communication with ambient air and in fluid communication with an area below the cooktop, and wherein the main body has openings which permit fluid communication between the main body and the area below the cooktop.

8. The gas burner unit of claim 1, wherein the plurality of protrusions extend above the top surface of the cooktop.

9. The gas burner unit of claim 8, wherein the protrusions extend about 2.9 mm above the top surface of the cooktop.

10. The gas burner unit of claim 1, wherein the gap has a height of at least about 2 mm to form a path for ambient air to flow from above the cooktop to the first ends of the plurality of upwardly directed primary air inlets.

11. A cooktop having at least one gas burner unit, comprising:

an opening defined through a surface of the cooktop;

a venturi extending through the opening and fluidically coupling with the gas burner unit; and a plurality of upwardly directed primary air inlets extending through the surface in fluid communication with the venturi and at least partially defining respective fluid paths from above the cooktop to the venturi; and a ridge extending upwardly about a perimeter of each upwardly directed primary air inlet.

12. The cooktop of claim 11, wherein each of the plurality of upwardly directed primary air inlets is adjacent the venturi.

13. The cooktop of claim 11, having two upwardly directed primary air inlets per gas burner unit.

14. The cooktop of claim 11, wherein the total cross sectional area of the upwardly directed primary air inlets is about 63 $mm^2$ or greater.

15. The cooktop of claim 11, wherein the venturi and the plurality of upwardly directed primary air inlets are defined by an orifice holder and wherein the venturi is in communication with a spreader, wherein the orifice holder maintains the spreader in a desired coaxial alignment by having at least one groove which receives a tab extending from the spreader.

16. The cooktop of claim 15, wherein the orifice holder is aluminum or brass.

17. The cooktop of claim 11, further comprising:

a plurality of alternate primary air inlets wherein the alternate primary air inlets intake ambient air from a location remote from the gas burner unit and supply it to the area under the cooktop, wherein the area under the cooktop is in fluid connection with the venturi.

18. A cooktop, comprising:

a plurality of gas burner units including a first gas burner unit having a spreader positioned above a surface of the cooktop to define a gap therebetween;

a first primary air inlet located remotely from the gas burner units to allow the ingress of ambient air to an area below the cooktop; and a second primary air inlet associated with the first burner unit, the second primary air inlet being positioned beneath the spreader to define at least a portion of a flow path from the gap to the area beneath the cooktop and further beneath the spreader.

19. The cooktop of claim 18, further comprising:

a protrusion extending upwardly around an exterior of the second primary air inlet.

20. The cooktop of claim 18, wherein:

the first burner unit further includes a venturi having an inlet in the area beneath the surface; and the flow path is in communication with the venturi.

* * * * *